United States Patent [19]

Raterman et al.

[11] Patent Number: 4,944,462

[45] Date of Patent: Jul. 31, 1990

[54] SHREDDER

[75] Inventors: Donald E. Raterman, Deerfield; John Muka, Harwood Heights, both of Ill.

[73] Assignee: Cummins-Allison Corp., Mt. Prospect, Ill.

[21] Appl. No.: 346,587

[22] Filed: May 2, 1989

[51] Int. Cl.[5] ..... B02C 4/08; B02C 18/16

[52] U.S. Cl. ..... 241/100; 241/166; 241/236; 241/295

[58] Field of Search ..... 241/236, 36, 100, 293, 241/295, 235, 166, 167

[56] References Cited

U.S. PATENT DOCUMENTS

| | | | |
|---|---|---|---|
| 221,744 | 11/1879 | Sanford . | |
| 313,987 | 3/1885 | Burckhardt . | |
| 1,090,914 | 3/1914 | Guettler . | |
| 2,236,969 | 4/1941 | Flateboe . | |
| 3,190,573 | 6/1965 | Biehn . | |
| 3,396,914 | 8/1968 | Liebman . | |
| 3,502,276 | 3/1970 | Panning et al. . | |
| 3,529,782 | 9/1970 | Liebman . | |
| 3,630,460 | 12/1971 | Goldhammer . | |
| 3,664,592 | 5/1972 | Schweigert et al. . | |
| 3,860,180 | 1/1975 | Goldhammer . | |
| 4,194,698 | 3/1980 | Kosmowski | 241/236 |
| 4,260,115 | 4/1981 | Hatanaka . | |
| 4,693,428 | 9/1987 | Raterman et al. . | |
| 4,776,525 | 10/1988 | Hatanaka . | |
| 4,793,561 | 12/1988 | Burda | 241/236 X |

FOREIGN PATENT DOCUMENTS

| | | | |
|---|---|---|---|
| 1264783 | 2/1972 | European Pat. Off. . | |
| 1315320 | 5/1973 | European Pat. Off. . | |
| 1513365 | 6/1978 | European Pat. Off. . | |
| 2335360 | 2/1975 | Fed. Rep. of Germany | 241/236 |
| 2524086 | 12/1976 | Fed. Rep. of Germany | 241/236 |
| 2749482 | 10/1979 | Fed. Rep. of Germany . | |
| 2831953 | 12/1979 | Fed. Rep. of Germany . | |
| 3413614 | 10/1985 | Fed. Rep. of Germany . | |
| 3806119 | 10/1988 | Fed. Rep. of Germany | 241/236 |
| 119845 | 8/1983 | Japan . | |
| 298253 | 11/1965 | Netherlands . | |
| 52909 | 8/1933 | Norway . | |
| 1491611 | 11/1977 | Switzerland . | |
| 2025788 | 1/1980 | United Kingdom . | |
| 2026342 | 2/1980 | United Kingdom . | |
| 2026907 | 2/1980 | United Kingdom . | |
| 2043812 | 10/1980 | United Kingdom . | |
| 2098359 | 11/1982 | United Kingdom . | |
| 2098503B | 11/1982 | United Kingdom . | |
| 2098503A | 11/1982 | United Kingdom . | |
| 2118065 | 10/1983 | United Kingdom . | |
| 2171028 | 8/1986 | United Kingdom | 241/236 |

*Primary Examiner*—Mark Rosenbaum

*Attorney, Agent, or Firm*—Arnold, White & Durkee

[57] ABSTRACT

A shredding device uses a plurality of interleaving, counter-rotating discs to reduce sheets of material into longitudinal strips. One or more notches, formed in the periphery of each disc, cut the longitudinal strips into segments. Deflectors disposed in the spaces between each disc clear unwanted material from between the discs. When jammed, the rotation of the discs reverses, and the notches bite into the jammed material to help remove it from between the discs.

22 Claims, 3 Drawing Sheets

SHREDDER

BACKGROUND OF THE INvENTION

1. Field of the Invention

This invention relates generally to shredding devices, and more particularly to shredders which cut sheet materials in two transverse directions.

2. Description of the Related Art

Most paper shredders employ a pair of counter-rotating rollers having a plurality of interleaved cutting elements. The cutting elements generally conform to one of two categories, toothed discs and smooth-surfaced discs of right cylindrical configuration. Shredders employing toothed discs are typically constructed by attaching a plurality of discrete toothed discs and interspersed spacers to a shaft. Shredders employing smooth-surfaced discs are typically constructed by milling a piece of roll stock to form a plurality of spaced apart discs. The latter construction technique is preferable since the entire machining process is conducive to fully automated milling machines.

Both types of shredders function similarly. As shreddable material, such as paper, is fed between the counter-rotating rolls, the interleaved cutting elements cut or tear the material into longitudinal strips using a scissor-like action. U.S. Pat. No. 3,630,460 issued Dec. 28, 1971 to Goldhammer discloses a smooth-surfaced disc shredder having a plurality of interleaved, counter-rotating discs which cut sheet materials into strips using a scissor-like action. The teeth of the toothed discs or grooves in the smooth discs grip the material and pull it between the juxtaposed rolls to produce tension in the material which facilitates shredding. U.S. Pat. No. 3,033,064 issued May 8, 1962 to Lee discloses a shredder having a plurality of notched discs. The notches grip sheets of paper to advance them between the rollers where the interleaved, counter-rotating discs cut the paper into strips.

However, in many applications, such as governmental document destruction, this type of destruction proves inadequate. There is the possibility that the content of these waste documents can be reconstructed since characters remain on the strips. Therefore, each type of shredder has been improved to shred materials in both the longitudinal and lateral directions. U.S. Pat. No. 4,565,330 issued Jan. 21, 1986 to Katoh discloses a toothed disc shredder which uses teeth to draw the sheet materials between the shredding rolls. After the circumferential edges of the discs cut the material into strips, the teeth, in cooperation with a back plate, cut the strips into chips. U.S. Pat. No. 3,860,180 issued Jan. 14, 1975 to Goldhammer discloses a smooth-surfaced disc shredder having notches formed in the outer periphery of each disc such that the notches are disposed in a helical fashion along each roll. As the circumferential edges of the discs cut the sheet material into strips, the trailing edge of the notches cut the material strips into segments.

Although the above-mentioned techniques usually destroy documents satisfactorily, they demonstrate some inadequacies. Shredders similar to the Katoh shredder use "metal-to-metal" contact to cut strips into segments. This contact causes a significant amount of wear on the discs and rollers. Moreover, this segmenting technique produces relatively more stress between the rollers than do shredders similar to the Goldhammer shredder. Shredders, such as the Goldhammer shredder, must hold the sheet material very tautly in order for the sharp nose of the trailing edge of the notch to penetrate and cut the material into segments. If the material is loose or too thick, the nose of the notch will not be able to segment the strips.

Furthermore, both types of shredders cut paper into longitudinal strips using essentially the same technique. The circumferential edges of each type of disc form 90° angles, and the interleaved discs produce a scissor-like action between the circumferential edges of adjacent discs. However, these edges are not sharp enough to cut through more than a few sheets of paper, and the cutting action relies heavily upon the tension or rigidity of the paper.

The present invention is directed to overcoming one or more of the problems set forth above.

SUMMARY OF THE INVENTION

It is the primary object of the present invention to provide a shredder which cuts sheet material in two transverse directions.

It is an important object of the present invention to provide a shredder that is resistant to jamming.

It is another object of the present invention to provide a shredder which requires less frequent maintenance than conventional shredders.

It is yet another object of the present invention to provide a shredder that clears jams quickly.

In accordance with the present invention, the foregoing objects are realized by a device for shredding sheet material which includes first and second parallel shafts mounted for rotation in opposite directions. A first plurality of discs are fixed on the first shaft for rotation therewith, and are spaced at intervals along the length of the first shaft. A second plurality of discs are fixed on the second shaft for rotation therewith, and are spaced at intervals along the length of the second shaft to interleave with the first plurality of discs. The periphery of each of the discs defines shredding blades. At least one notch is formed in the periphery of each disc so that each of the notches narrows toward the periphery of each disc to form opposed pointed portions.

As sheet material passes between the counter-rotating shafts, the interleaving discs cut the sheet material in a longitudinal direction, which is perpendicular to the axes of the shafts. The notches extend transversely across the periphery of the discs, and cut the sheet material in a direction parallel to the axes of the shafts. Therefore, the shredded sheet is cut in two transverse directions by a combination of the interleaving discs and the notches formed in the periphery of the discs. Since the notches narrow toward the periphery of each disc, they form opposed pointed portions which cut into the sheet material. The pointed portion which points in the direction of rotation cuts the sheet material. During normal operation, one of the opposed pointed portions cuts the sheet material, and, when the device is jammed, such as when too much sheet material is between the opposed shafts, the shafts reverse the direction of rotation and the other pointed portion bites into the material to force the material out of the device.

To shred larger volumes of paper or the like, the outer periphery of each disc forms a V-shape to produce sharp axial edges. The sharp axial edges of the interleaving discs produce a sharper cutting edge for cutting material in the longitudinal direction. When the periphery contains a V-shaped notch, as described above, each of the opposed pointed portions include two cutting points. The cutting points penetrate into the sheet material, and improve the transverse cutting action of the device. Moreover, if the device becomes jammed, the cutting points assist in the removal of the jammed material by piercing the material so that the material reverses direction easily.

BRIEF DESCRIPTION OF THE DRAWINGS

Other objects and advantages of the invention will become apparent upon reading the following detailed description and upon reference to the drawings in which.

Figure 1:
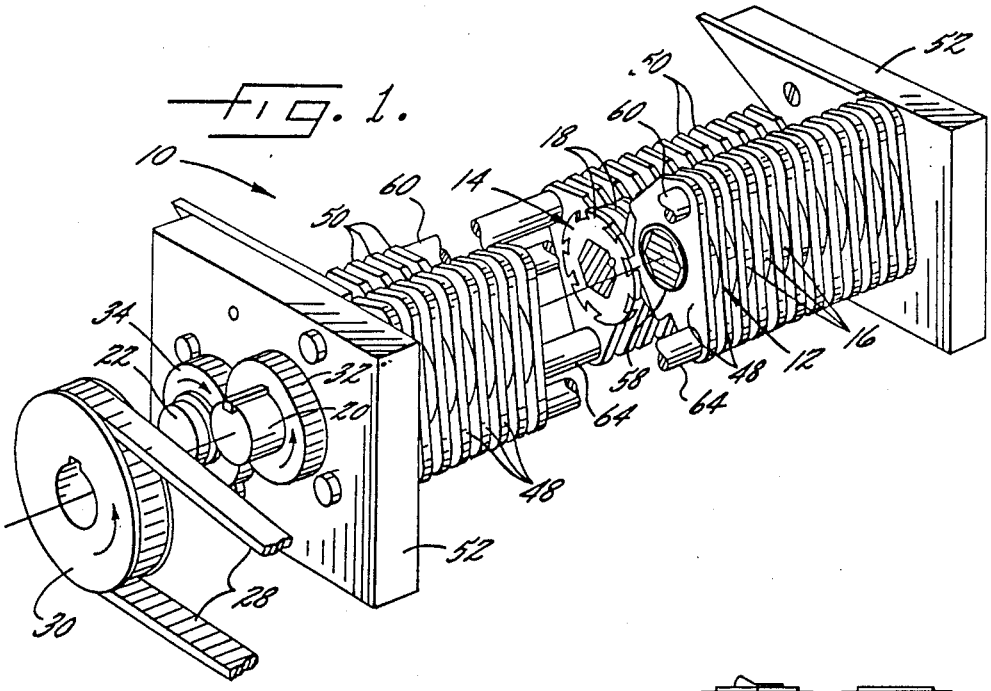
FIG. 1 is a perspective view of a shredding device embodying the present invention.

While the invention is susceptible to various modifications and alternative forms, specific embodiments thereof have been shown by way of example in the drawings and will be described in detail herein. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENT

Referring initially to FIG. 1, a device 10 for shredding sheet material is shown in a perspective illustration. The device 10 includes a pair of rollers 12,14 which are rotatably mounted opposite one another on bearings with the axes of rotation parallel to one another. The rollers 12,14 are geared to rotate in opposite directions, i.e., counter-rotate. A plurality of discs 16,18 are fixed on each roller shaft 20,22, respectively, at spaced intervals along the length of each shaft 20,22. The spaced intervals are selected so that the discs 16 on the shaft 20 interleave with the discs 18 on the other shaft 22. Shreddable materials which pass between the interleaving, counter-rotating discs 16,18 are cut by the cooperating discs.

Figure 2:
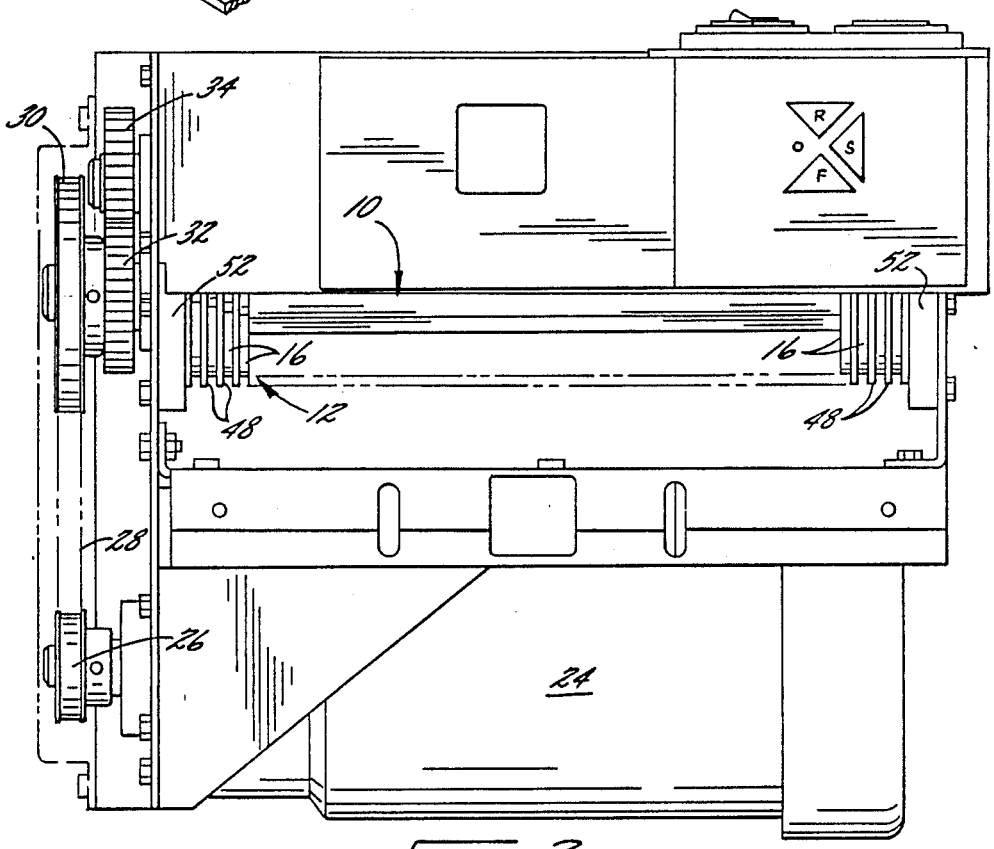
FIG. 2 is a top plan view of a shredding device embodying the present invention.

FIG. 2 is a top plan view of the shredding device 10 which uses a motor 24 to drive a sprocket 26. To transfer the driving force to the rollers 12,14, a belt or chain 28 connects the sprocket 26 to a sprocket 30 which is attached to one end of one of the rollers 12. A gear 32 fixed on the driven roller 12 meshes with a gear 34 fixed on the other roller 14 so that each roller counter-rotates with respect to the other. Preferably, these gears 32,34 are substantially identical so that each roller 12,14 operates at the same speed. However, should an application require one roller to rotate faster than the other roller, one need simply fit an appropriate gear onto one of the shafts 20,22. For most applications, however, the rollers 12,14 rotate at the same speed of about 30 to 60 lineal feet per minute.

Figure 3:
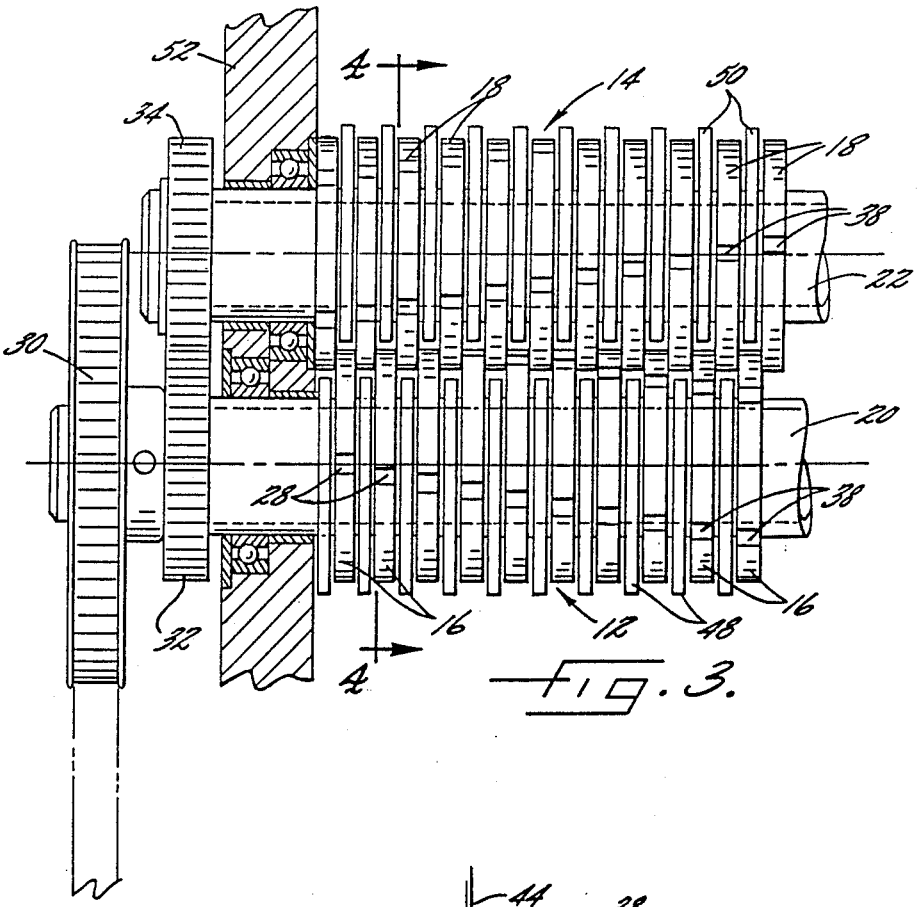
FIG. 3 is a plan view of a pair of shredder rollers embodying the present invention.
Figure 4:
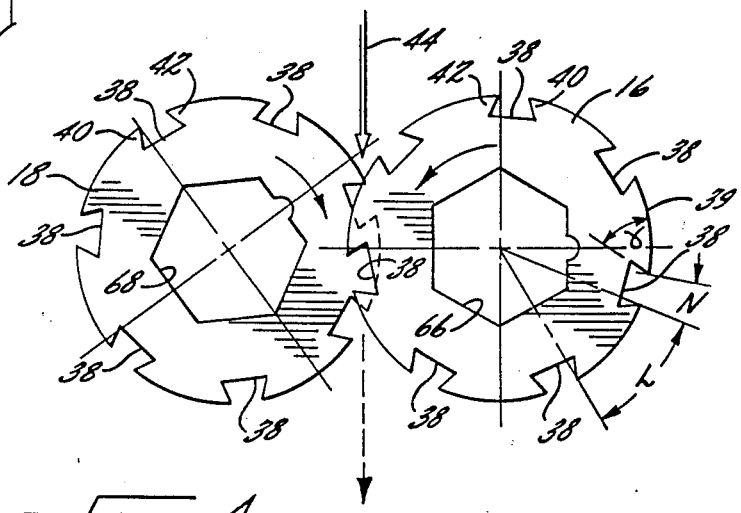
FIG. 4 is a sectional view along line 4—4.
Figure 5:
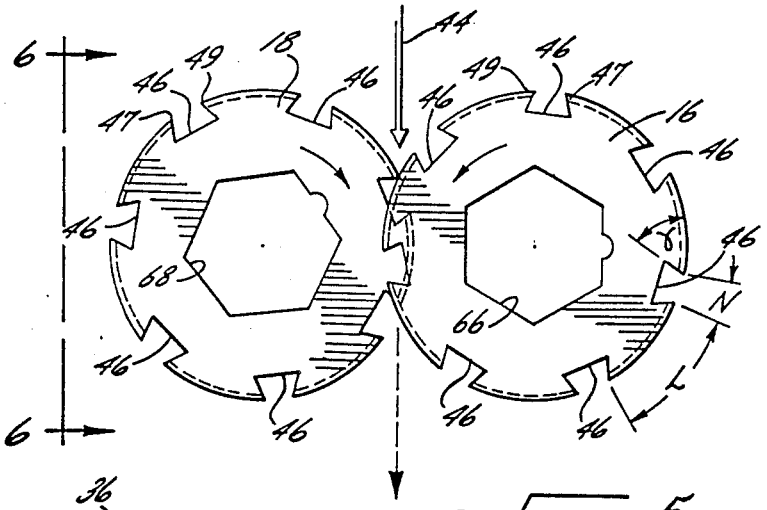
FIG. 5 is an alternate sectional view along line 4—4.

As the rollers 12,14 counter-rotate, the interleaving discs 16,18, shown in FIGS. 3, 4 and 5, cut sheet materials passing between the rollers 12,14 into longitudinal strips. The axial edges of each disc 16 are positioned within the spaced intervals formed between the discs 18 on the opposite shaft. This interleaving arrangement places the axial edge of one disc 16 adjacent the axial edge of an opposing disc 18 to form a scissor-like cutting tool. The interleaving discs 16,18 place the sheet material under tension so that the scissor-like cutting action of the discs 16,18 tears through the material. Preferably, the axial thickness of each disc 16,18 is slightly less than the space between adjacent discs to allow the opposing discs to interleave while keeping them closely adjacent for optimum cutting action. The axial thickness of each disc 16,18 also determines the width of the strip produced by the cutting rollers 12,14. For materials such as confidential documents which require unreconstructable destruction, thinner discs cut material into thinner strips for more complete destruction. The majority of shredding applications utilize discs of about 0.100 inches to about 0.300 inches in thickness.

Most sheet materials, such as paper or cardboard, have an inherent rigidity which allows them to be cut in this scissor-like fashion, and which prevents the materials from wrapping around the interleaving discs instead of shredding. Materials, such as thin plastic or onion skin paper, have poor rigidity and are often torn unevenly, or not at all, by shredding devices. Therefore, enhancing the piercing or cutting force of the shredding device 10 improves its ability to cut extremely thick or very thin materials.

Figure 6:
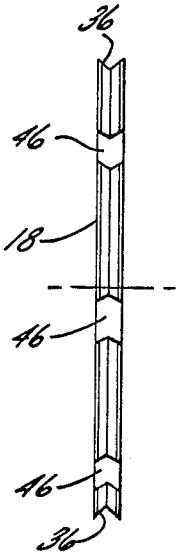
FIG. 6 is an end view along line 6—6.

For cutting thicker volumes of material or very thin material FIG. 6 shows an end view of a disc 16,18 which has a V-shaped peripheral edge 36. The V-shaped edge 36 provides a sharper edge than conventional smooth-surfaced discs which have 90° edges. The adjacent axial V-shaped edges 36 of the interleaving discs 16,18 improve the cutting effect of the rollers 12,14 because the sharper V-shaped edges exert more force per unit area than the conventional 90° edges. These sharper edges reduce the dependence of the shredding device 10 on the rigidity of the sheet material. Moreover, the V-shaped edge 36 provides a greater amount of space between the periphery of the discs 16,18 and the outer diameter of the shaft 20,22 This produces less stress between the rollers 12,14 during shredding, and, therefore, allows the device 10 to shred greater thicknesses of sheet material as compared to similar smooth-surfaced shredders.

To destroy a document such that it cannot be reconstructed, it is preferable to cut it in two directions. As illustrated in FIG. 4, notches 38 are formed in the periphery of each disc 16,18 to laterally cut the longitudinal strips into segments or chips. The notches 38 generally narrow toward the periphery of said each disc 16,18 to form opposed pointed portions 40,42. As shown, the notches 38 are in the form of a regular trapezoid where the base of the trapezoid is nearer the center of the disc than the top of the trapezoid, which extends outwardly toward the periphery of the disc. An angle $\alpha$ is defined between an outwardly extending side of a notch 38 and a line tangent to the periphery of the disc. The angle $\alpha$ is preferably less than 90° so that the acute angle $\alpha$ forms a sharp cutting edge. However, when using case hardened steel as a disc material, the angle $\alpha$ should not be much smaller than about 60° to avoid possible damage to the pointed portions 40,42 during use.

As the rollers 12,14 rotate in the direction shown by the arrows, the pointed portion 40 of the notch 38 which is pointing in the direction of rotation cuts laterally through the sheet material 44. The lateral incisions formed by the pointed portions 40,42 are perpendicular to the longitudinal incisions since the edges of the pointed portions 40,42 are parallel to the axes of rotation of the shafts 20,22. The lateral incision is made first, and the longitudinal cut is made as the sheet material continues through the rollers 12,14. Therefore, the sheet material 44 is under longitudinal tension as the lateral incision is made.

FIG. 5 illustrates a trapezoidal notch 46 formed in a disc 16 having a V-shaped periphery. The notch 46 is capable of cutting through thicker and tougher materials than the same notch 38 formed in a disc having a smooth or flat periphery. While the notch 38 formed in the periphery of a smooth-surfaced disc cuts materials with a blade-like edge, the similar notch 46 formed in V-shaped periphery 36 of a disc 16 cuts sheet materials 44 with one of the opposed double-pointed edges 47,49. The double-pointed edges exert more force onto the same area of sheet material, so that the edges penetrate the sheet material better and cut the longitudinal strips into segments more efficiently. As can be seen in FIG. 5, the double-pointed edge 47 of the notch 46 contacts the sheet material as the discs 16,18 intersect. The transverse cut is made first, and the longitudinal cut is made as the sheet material continues through the rollers 12,14. The depth of the V generally determines the thickness of the sheet material which can be effectively cut transversely. Deeper V-shapes cut thicker volumes of sheet material, but tend to be more susceptible to damage than shallower V-shapes. The discs 16,18 are preferably about 3 inches in diameter, and the depth of the V-shape is about 0.045 inches to about 0.100 inches. It should be noted that a V-shaped edge which is too deep may have difficulty transversely cutting the sheet material before the longitudinal cut intersects with the transverse cut. In this instance the transverse cut may occasionally not be completed since the longitudinal tension of the sheet lessens when the cuts intersect.

The interleaving discs 16,18 will efficiently cut sheet materials in both the longitudinal and lateral directions given the proper timing between the discs on the opposing shafts. FIGS. 4 and 5 illustrate opposing discs 16,18 where a notch on one disc 16 properly overlaps with a land on the other disc 18. In contrast, if a notch of one disc 16 overlaps with a notch of the other disc 18, then there will be no scissor-like cooperation between the opposing discs, and, therefore, no longitudinal incision will be made. Hence, the belt 30 and the gears 32 and 34 are selected to properly rotate the plurality of discs 16,18 which are fixed in a preselected pattern on the shafts 20,22.

To maintain a relatively constant torque on the driving motor 24 during shredding, the notches 38,46 form a helical pattern along the rollers 12,14. This pattern distributes the transverse cutting action of the rollers 12,14 so that a substantially equal number of transverse cuts are being made constantly. The relatively constant cutting action prevents undue stress on the device 10, and allows the use of a smaller motor to keep the device 10 light and compact enough for office use.

Referring again to FIGS. 4 and 5, it has been found that if the circumferential measurement L of lands 39, which separate the respective notches 38,46 on a disc 16,18, is two to four times greater than the circumferential measurement N of the notches 38,46, then the shredded material does not tend to accumulate between the interleaved discs 16,18. Since the accumulation of shredded material between the discs 16,18 lowers the efficiency of the device 10 and causes jams, a proper ratio of L:N improves the performance of the device 10 and reduces down-time for clearing jams.

If more material is fed into the device 10 than it can shred, the rollers 12,14 may jam. To help clear jams, the direction of rotation of the rollers 12,14 is reversed. This may be accomplished in a variety of ways, but, preferably, an inductor senses the motor current. When the sensed current rises above a predetermined level, an associated microprocessor delivers a signal which reverses the motor. Since the material is too thick or tough to be shredded properly, the opposite portions 42,49 of the notches 38,46, which are now pointed in the direction of rotation, bite into the jammed material to help force it from between the rollers 12,14.

Preferably, the discs 16,18 are discrete discs, and are attached to a discrete shaft. A disc 16,18 is stamped into the general notched shape, and then ground to produce a finished disc. The discs are spaced apart by a plurality of discrete spacers 58 which fit within an aperture 62 in the deflectors 48,50. The discs 16,18 include hexagonal apertures 66,68 which fit onto a shaft having a hexagonal cross-section. Consecutive discs 16 are rotated by 60° and mounted on the hexagonal shaft. This mounting scheme produces the helical pattern mentioned above. As illustrated, each disc preferably includes seven notches 38,46 spaced at equal intervals about the periphery of the disc. Therefore, the angular spacing between each notch is about 51.4° and produces a helix angled at about 8.6° with respect to the axis of the shaft.

Figure 7:
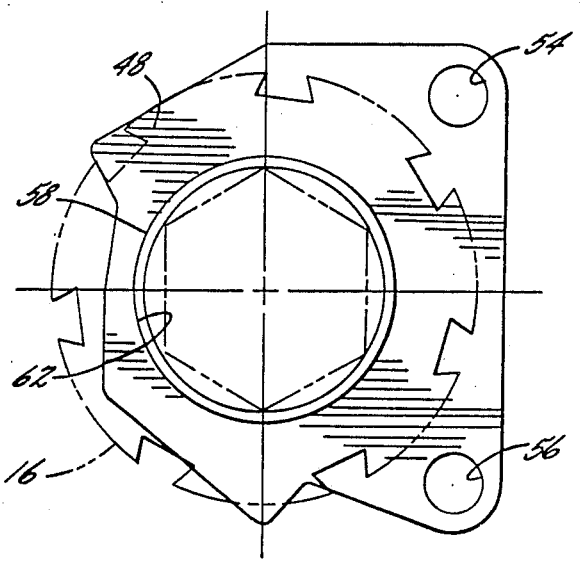
FIG. 7 is a plan view of a deflector.

As the rollers 12,14 counter-rotate and shred materials, the shredded materials can become compressed in the spaces between the discs 16,18. To clean material from the rollers 12,14 during normal operation, deflectors 48,50 fit into the spaces between the discs 16,18 on the respective shafts 20,22. (See FIGS. 3 and 7). The deflectors 48,50 are attached to rods 60,64 on the frame 52 of the device 10 by mounting holes 54,56 so that the deflectors 48,50 are positioned to remove the compressed material from the rollers 12,14. Torn material in the notches 38,46 may extend beyond the axial edges of the discs 16,18, so the deflectors 48,50 also help remove material from the notches 38,46. The deflectors 48,50 are positioned so that the material extracted by the deflectors 48,50 falls into a bin or similar container along with the rest of the shredded material.

Alternatively, the rollers 12,14 may be fabricated from a piece of solid roll stock using a milling process. Numerical control machines currently on the market are easily programmed to automatically mill circumferential slots in a piece of roll stock to form the individual discs. The cutting tool of the automatic milling machine can be placed at the proper angles to mill notches into the peripheries of the discs to produce a notch which is narrow near the periphery of the disc and wider toward the axis of the roll stock. To decrease the weight of the device 10, the center of the shafts 20,22 may be bored out without effecting the strength of the rollers 12,14.

We claim:

1. A device for shredding sheet material, comprising:

first and second parallel shafts mounted for rotation in opposite directions;

a first plurality of discs fixed on said first shaft for rotation therewith and spaced at intervals along the length of said first shaft;

a second plurality of discs fixed on said second shaft for rotation therewith and spaced at intervals along the length of said second shaft to interleave with said first plurality of discs, wherein the periphery of each of said first and second plurality of discs has a V-shaped cross-section to form dual shredding blades at the axial edges of each disc;

at least one notch formed in the periphery of each disc, each of said notches narrowing toward the periphery of said each disc to form opposed double-pointed portions.

2. The device, as set forth in claim 1, further comprising:

a first plurality of deflectors being disposed about said first shaft within the spaced intervals between said plurality of discs on said first shaft; and a second plurality of deflectors being disposed about said second shaft within the spaced intervals between said second plurality of discs on said second shaft.

3. The device, as set forth in claim 2, wherein said deflectors are adapted for removing material from the spaced intervals between adjacent discs on said respective shafts.

4. The device, as set forth in claim 2, wherein said deflectors direct shredded material into a bin.

5. The device, as set forth in claim 1, wherein:

said notches are distributed in a rows along the length of said shaft in a helical pattern.

6. The device, as set forth in claim 1, wherein:

said rotating, interleaving discs cut sheet material passing therebetween into longitudinal strips, and each of said double-pointed portions which points in the direction of rotation cuts the longitudinal strips laterally.

7. The device, as set forth in claim 6, wherein:

said lateral cut is perpendicular to said longitudinal cut.

8. The device, as set forth in claim 7, wherein:

the direction of rotation of each shaft is reversed to clear sheet materials which are jammed between the interleaving discs.

9. The device, as set forth in claim 8, wherein:

each of said double-pointed portions which points in the direction of rotation bites into said jammed sheet material thereby assisting removal of said jammed sheet material from between said interleaving discs.

10. The device, as set forth in claim 1, wherein each of said notches are in the form of a regular trapezoid Which narrows toward the periphery of said disc.

11. The device, as set forth in claim 1, wherein:

each of said plurality of discs includes a plurality of notches formed in the periphery thereof, said notches having peripheral lands therebetween.

12. The device, as set forth in claim 11, wherein the circumferential length each of said lands is between two and four times the circumferential length of each of said notches.

13. A device for shredding sheet material, comprising:

first and second parallel shafts mounted radially adjacent one another for rotation in opposite directions;

a first plurality of discs fixed on said first shaft for rotation therewith and spaced at intervals along the length of said first shaft;

a second plurality of discs fixed on said second shaft for rotation therewith and spaced at intervals along the length of said second shaft to interleave with said first plurality of discs, wherein the periphery of each of said first and second plurality of discs has a V-shaped cross-section to form dual shredding blades at the axial edges of each disc;

a plurality of notches formed in the periphery of each disc, each of said notches narrowing toward the periphery of said each disc to form opposed acute double-pointed portions, said notches having peripheral lands therebetween wherein the circumferential length each of said lands is between two and four times the circumferential length of each of said notches;

a first plurality of deflectors being disposed about said first shaft within the spaced intervals between said plurality of discs on said first shaft; and a second plurality of deflectors being disposed about said second shaft within the spaced intervals between said second plurality of discs on said second shaft, said first and second plurality of deflectors being held stationary with respect to said respective rotating shafts.

14. The device, as set forth in claim 13, wherein:

the direction of rotation of each shaft is reversed to clear sheet materials which are jammed between the interleaving discs.

15. The device, as set forth in claim 13, wherein:

each of said material cutting edges which points in the direction of rotation bites into said jammed sheet material thereby assisting removal of said jammed sheet material from between said interleaving discs.

16. A cutting roller for a sheet material shredding device, comprising:

a shaft;

a plurality of discs fixed on said shaft and spaced at intervals along the length of said shaft, wherein the periphery of each discs has a V-shaped cross section to form dual shredding blades at the axial edges of each disc;

at least one notch formed in the periphery of each disc, each of said notches narrowing toward the periphery of said each disc to form opposed double-pointed portions.

17. The cutting roller, as set forth in claim 16, wherein:

said notches are distributed in a rows along the length of said shaft in a helical pattern.

18. The cutting roller, as set forth in claim 16, wherein each of said notches are in the form of a regular trapezoid which narrows toward the periphery of said disc.

19. The cutting roller, as set forth in claim 16, wherein:

each of said plurality of discs includes a plurality of notches formed in the periphery thereof, said notches having peripheral lands therebetween.

20. The cutting roller, as set forth in claim 19 wherein the circumferential length each of said lands is between two and four times the circumferential length of each of said notches.

21. A cutting roller for a sheet material shredding device, comprising:

a shaft;

a plurality of discs fixed on said shaft for rotation therewith and spaced at intervals along the length of said shaft, wherein the periphery of each disc has a V-shape cross section to form dual shredding blades at the axial edges of each disc;

a plurality of notches formed in the periphery of each disc, each of said notches narrowing toward the periphery of said each disc to form opposed double-pointed portions, said notches having peripheral lands therebetween wherein the circumferential length each of said lands is between two and four times the circumferential length of each of said notches.

22. A device for shredding sheet material, comprising first and second parallel shafts mounted for rotation in opposite directions;

a first plurality of discs fixed on said first shaft for rotation therewith and spaced at intervals along the length of said first shaft;

a second plurality of discs fixed on said second shaft for rotation therewith and spaced at intervals along the length of said second shaft to interleave with said first plurality of discs, wherein the periphery of each disc has a V-shaped cross second to form dual shredding blades at the axial edges of each disc;

at least one material cutting notch formed in the periphery of each disc, each of said notches narrowing toward the periphery of said each disc to form opposed double-pointed acute cutting edges which extend parallel to the axis of rotation of said respective shafts;

whereby sheet material passing between said oppositely rotation plurality of discs is cut into strips between the shredding blades of each pair of interleaving first and second discs, and said strips are cut into segments by the double-pointed edges of said material cutting notches.

* * * * *